United States Patent [19]

New

[11] Patent Number: 4,742,266

[45] Date of Patent: May 3, 1988

[54] COLOR PICTURE TUBE HAVING AN INLINE ELECTRON GUN WITH AN EINZEL LENS

[75] Inventor: David A. New, Manheim Township, Lancaster County, Pa.

[73] Assignee: RCA Corporation, Princeton, N.J.

[21] Appl. No.: 75,782

[22] Filed: Jul. 20, 1987

[51] Int. Cl.[4] ..... H01J 29/62

[52] U.S. Cl. ..... 313/414

[58] Field of Search ..... 313/414

[56] References Cited

U.S. PATENT DOCUMENTS

| | | | |
|---|---|---|---|
| 3,448,316 | 6/1969 | Yoshida et al. | 313/414 X |
| 3,898,521 | 8/1975 | Saito et al. | 315/370 |
| 3,949,262 | 4/1976 | Ohkoshi et al. | 313/414 X |
| 4,124,810 | 11/1978 | Bortfeld et al. | 313/414 X |
| 4,178,532 | 12/1979 | Fukuzawa et al. | 313/414 |
| 4,232,246 | 11/1980 | Sakurai et al. | 313/414 |
| 4,429,252 | 1/1984 | Vieland et al. | 313/414 |
| 4,668,892 | 5/1987 | Peels | 313/414 |

*Primary Examiner*—Palmer C. DeMeo

*Attorney, Agent, or Firm*—Eugene M. Whitacre; Dennis H. Irlbeck

[57] ABSTRACT

The present invention provides an improvement in color picture tubes. Such tubes include an electron gun for generating and directing three inline electron beams, a center beam and two side beams, along initially coplanar paths toward a screen of the tube. The gun includes a plurality of spaced electrodes which form a main focus lens for focusing the electron beams. The improvement comprises the plurality of spaced electrodes which form a main focus lens including three electrodes that form an einzel lens in the path of each electron beam. A first einzel lens electrode includes a first portion having three inline apertures that are set back from a second portion forming a single large aperture through which all three electron beams pass. A second einzel lens electrode includes a first portion having three inline apertures that are set back from a second portion forming a single large aperture through which all three electron beams pass. The second portion of the first einzel lens electrode faces the second portion of the second einzel lens electrode. A second einzel lens electrode also includes a third portion having three inline apertures that are set back from a fourth portion forming a single large aperture through which all three electron beams pass. A third einzel lens electrode includes a first portion having three inline apertures set back from a second portion forming a single large aperture through which all three electron beams pass. The fourth portion of the second einzel lens electrode faces the second portion of the third einzel lens electrode.

4 Claims, 5 Drawing Sheets

WELL ALIGNED BFR

ELECTRON GUN OF TABLE II

ELECTRON GUN OF TABLE I

I MIL VERTICAL G2 MISALIGNMENT

PRIOR ART ELECTRON GUN

COLOR PICTURE TUBE HAVING AN INLINE ELECTRON GUN WITH AN EINZEL LENS

This invention relates to color picture tubes having inline electron guns and, particularly, to an inline gun having an einzel lens as a main focus lens.

BACKGROUND OF THE INVENTION

An einzel lens, also called a saddle lens or a unipotential lens, is an electrostatic lens formed by three electrodes, a center electrode and two side electrodes. The center electrode is either connected to a ground potential or to a relatively low voltage potential. The two side electrodes are connected to a relatively high potential which usually is the anode potential. The focus of an einzel lens is slightly less sharp than that of a bipotential lens, but the einzel lens has the advantage that it does not require a second high voltage for a focus electrode. Einzel lens electron guns have been commercially used in color picture tubes, such as in the G.E. Portacolor, the RCA 15NP22 and the Sony Trinitron. The RCA 15NP22 had a delta electron gun and the G.E. Portacolor and Sony Trinitron used inline guns. The RCA and G.E. electron guns had individual tubular electrodes as the center and side electrodes in the paths of each electron beam. The Sony electron gun had large tubular electrodes as the center and side electrodes through which the three electron beams passed, crossing over each other at the center of the einzel lens.

Electron gun designs for use in large screen entertainment-type color picture tubes must be capable of generating small-sized high-current electron beam spots at the tube's screen. This requires a beam-forming region (BFR) in an electron gun which produces beams that can be easily focused and a main focus lens in the gun that has low aberrations. The beam-forming region of an electron gun comprises the cathodes, control grid (G1), screen grid (G2) and a portion of a focus electrode (G3) that faces the screen grid. An important requirement for a beam-forming region is that it produce beams having uniform current density across their cross-sections. Several new beam-forming region designs have been developed that accomplish such uniform current densities by selective prefocusing the center and outer parts of the beam in the G2-G3 region. When these new beam-forming regions are used with bipotential main focus lenses, very high performance can be achieved. However, the performance of such bipotential electron guns that incorporate the new beam-forming regions is extremely sensitive to misalignments in the beam-forming region. In some cases, this sensitivity is as much as seven times greater than is the misalignment sensitivity in more conventional electron guns. It appears that there are misalignment tolerances inherent in present manufacturing techniques that may render the electron guns using the newer beam-forming regions unusable. Therefore, there is a need for a new electron gun design that can take advantage of the newer beam-forming region designs by being less sensitive to misalignment in the beam-forming region.

SUMMARY OF THE INVENTION

The present invention provides an improvement in color picture tubes. Such tubes include an electron gun for generating and directing three inline electron beams, a center beam and two side beams, along initially coplanar paths toward a screen of the tube. The gun includes a plurality of spaced electrodes which form a main focus lens for focusing the electron beams. The improvement comprises the plurality of spaced electrodes which form the main focus lens including three electrodes that form an einzel lens in the paths of the electron beams. A first einzel lens electrode includes a first portion having three inline apertures that are set back from a second portion that forms a single large aperture through which all three electron beams pass. A second einzel lens electrode includes a first portion having three inline apertures that are set back from a second portion that forms a single large aperture through which all three electron beams pass. The second portion of the first einzel lens electrode faces the second portion of the second einzel lens electrode. The second einzel lens electrode also includes a third portion having three inline apertures that are set back from a fourth portion that forms a single large aperture through which all three electron beams pass. A third einzel lens electrode includes a first portion having three inline apertures set back from a second portion that forms a single large aperture through which all three electron beams pass. The fourth portion of the second einzel lens electrode faces the second portion of the third einzel lens electrode.

DETAILED DESCRIPTION OF THE PREFERRED EMBODIMENT

Figure 1:
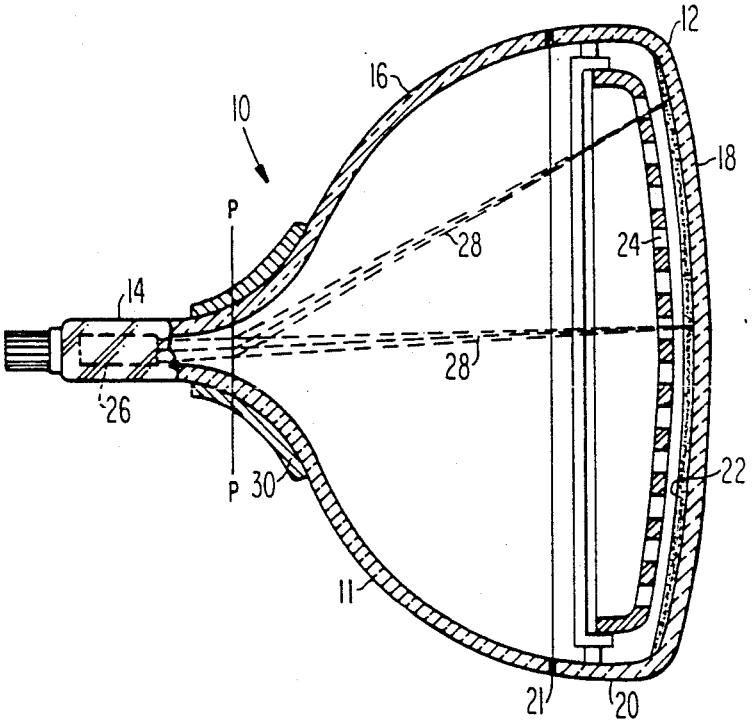
FIG. 1 a plan view, partly in axial section, of a shadow mask color picture tube embodying the invention.
Figure 2:
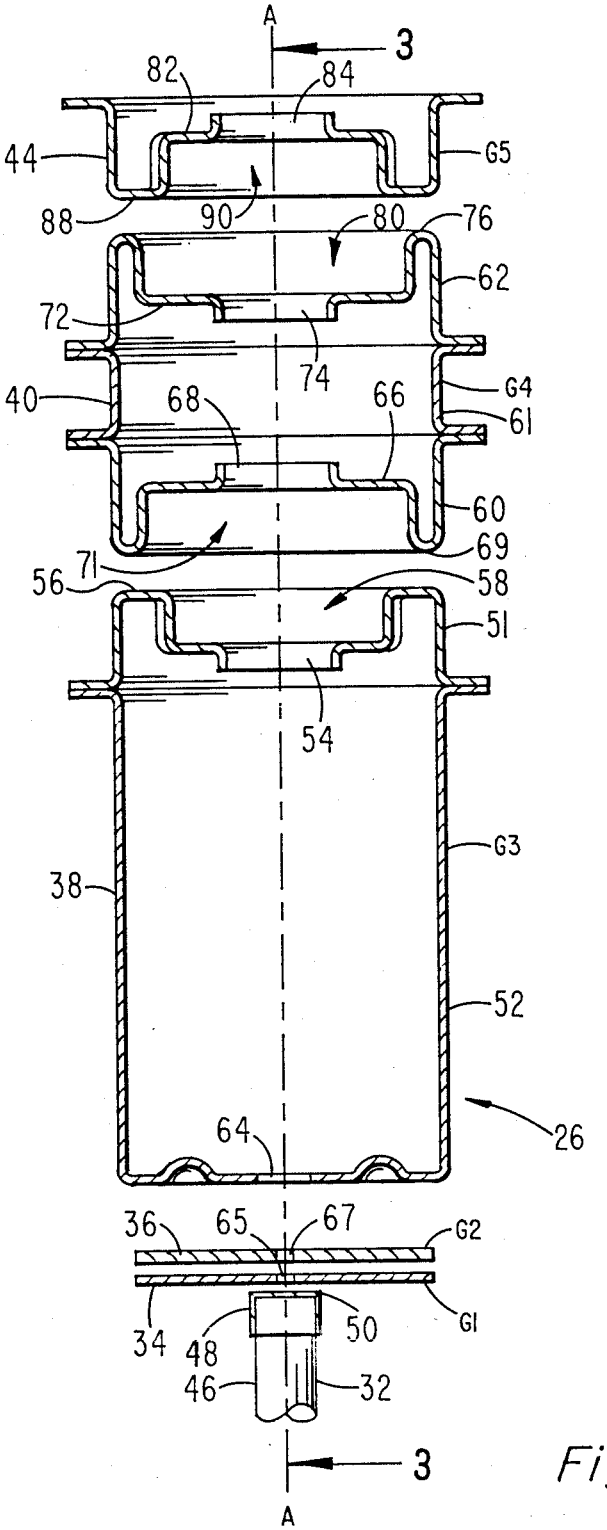
FIGS. 2 and 3 are axial section side and top views, respectively, of the electron gun shown in dashed lines in FIG. 1.
Figure 3:
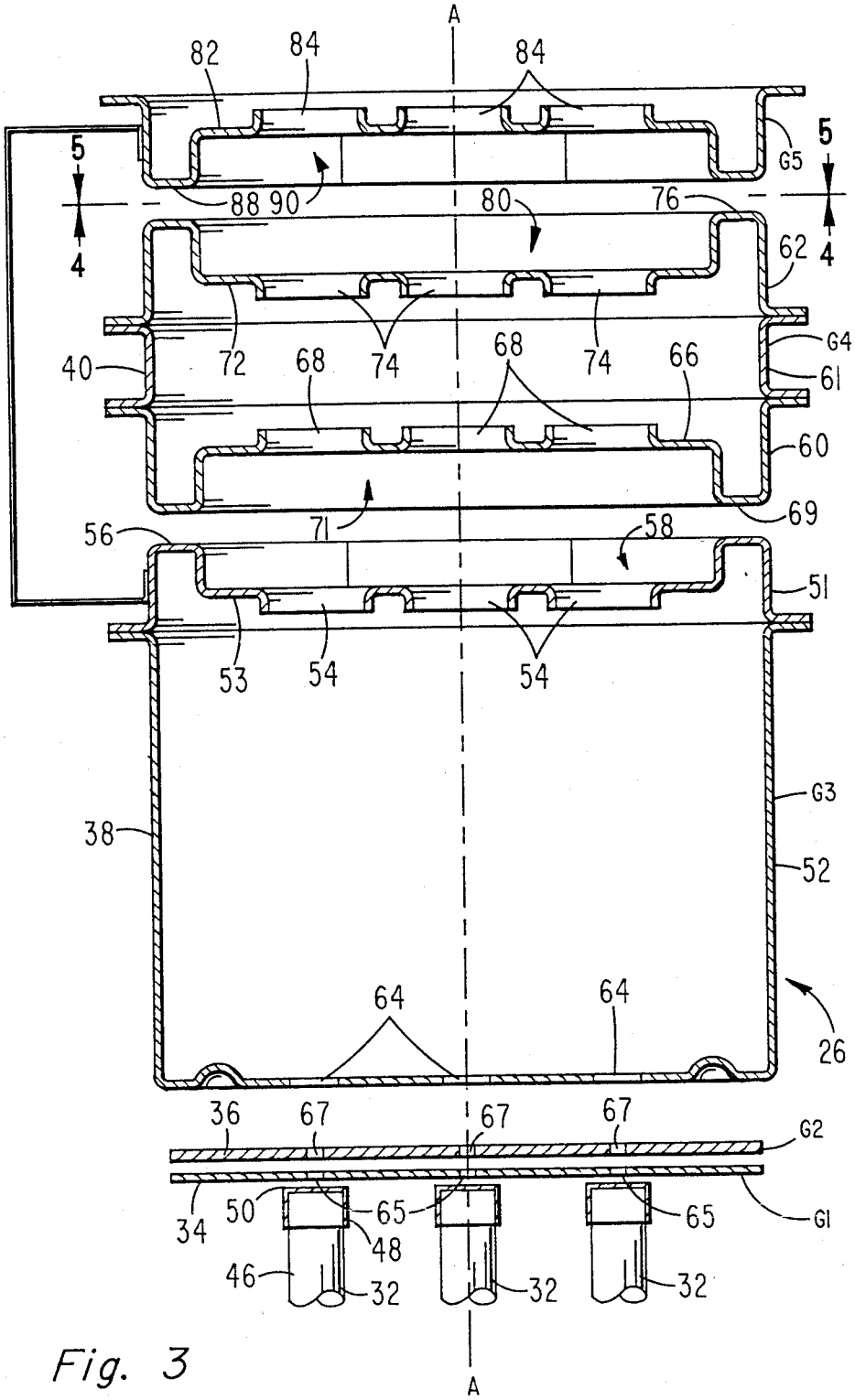

FIG. 1 shows a rectangular color picture tube 10 having a glass envelope 11 comprising a rectangular faceplate panel 12 and a tubular neck 14 connected by a rectangular funnel 16. The panel 12 comprises a viewing faceplate 18 and a peripheral flange or sidewall 20 which is sealed to the funnel 16 with a frit seal 21. A mosaic three-color phosphor screen 22 is located on the inner surface of the faceplate 18. The screen preferably is a line screen with the phosphor lines extending substantially perpendicular to the high frequency raster line scan of the tube (normal to the plane of FIG. 1). Alternatively, the screen could be a dot screen. A multiapertured color selection electrode or shadow mask 24 is removably mounted, by conventional means, in predetermined spaced relation to the screen 22. An improved inline electron gun 26, shown schematically by dashed lines in FIG. 1, is centrally mounted within the neck 14 to generate and direct three electron beams 28 along coplanar convergent paths through the mask 24 to the screen 22.

The tube of FIG. 1 is designed to be used with an external magnetic deflection yoke, such as the yoke 30 in the neighborhood of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is shown by the line P—P in FIG. 1 at about the middle of the yoke 30. Because of fringe fields, the zone of deflection of the tube extends axially from the yoke 30 into the region of the gun 26. For simplicity, the actual curvature of the deflection beam paths in the deflection zone is not shown in FIG. 1.

The details of the gun 26 are shown in FIGS. 2, 3, 4 and 5. The gun 26 comprises three equally spaced coplanar cathodes 32 (one for each beam), a control grid electrode 34 (G1), a screen grid electrode 36 (G2), a first einzel lens electrode 38 (G3), a second einzel lens electrode 40 (G4), and a third einzel lens electrode 44 (G5) spaced in the order named and attached to two support rods (not shown).

The cathodes 32, the G1 electrode 34, the G2 electrode 36 and the side of the G3 electrode 38 facing the G2 electrode 36 comprise the beam forming region of the electron gun 26. The other side of the G3 electrode 38, the G4 electrode 40, and the G5 electrode 44 comprise the main focusing lens portion of the gun 26. The main focusing lens is a unipotential type, usually called an einzel lens. In this gun, the G3 electrode 38 is electrically connected to the G5 electrode 44 which, in turn, is connected to the anode potential. The G4 electrode 40 is connected to a focus voltage which is a relatively low potential compared to the anode potential.

Each cathode 32 comprises a cathode sleeve 46, closed at the forward end by a cap 48 having an end coating 50 of electron emissive material. Each cathode 32 is indirectly heated by a heater coil positioned within the sleeve 46. The control and screen grid electrodes, 34 and 36, are two closely-spaced flat plates each having three sets of small aligned apertures 65 and 67, respectively, centered with the cathode coatings 50 to initiate three equally-spaced coplanar electron beams 28 extending toward the screen 22. Preferably, the initial electron beam paths are substantially parallel, with the middle path coincident with the central axis A—A.

The G3 electrode 38 is a first einzel lens electrode that includes two parts 51 and 52. A first portion 53 of the first part 51 of the first einzel lens electrode 38 is flat, having three inline apertures 54 therein. The first portion 53 is set back within a recess from a second portion 56 of the first part 51 of the first einzel lens electrode 38. The second portion 56 is a continuous rim that forms a single large aperture 58 through which all three electron beams 28 pass. A second part 52 of the electrode 38 is cup-shaped with its open end attached to the first part 51 and its bottom having three inline apertures 64 therein facing the G2 electrode 36.

The G4 electrode 40 is a second einzel lens electrode that includes three parts 60, 61 and 62. A first portion 66 of the first part 60 of the second einzel lens electrode 40 is flat, having three inline apertures 68 therein. The first portion 66 is set back within a recess from a second portion 69 of the first part 60 of the second einzel lens electrode 40. The second portion 69 is a continuous rim that forms a single large aperture 71 through which all three electron beams pass.

The second part 61 of the second einzel lens electrode 40 is a cylinder having flanged ends attached between the first and third parts, 60 and 62. A first portion 72 of the third part 62 of the second einzel lens electrode 40 is flat, having three inline apertures 74 therein. The first portion 72 is set back within a recess from a second portion 76 of the third part 62 of the second einzel lens electrode 40. The second portion 76 is a continuous rim that forms a single large aperture 80 through which all three electron beams pass.

The G5 electrode 44 is a third einzel lens electrode. A first portion 82 of the third einzel lens electrode 44 is flat, having three inline apertures 84 therein. The first portion 82 is set back within a recess from a second portion 88 of the third einzel lens electrode 44. The second portion 88 is a continuous rim that forms a single large aperture 90 through which all three electron beams pass.

Figure 4:
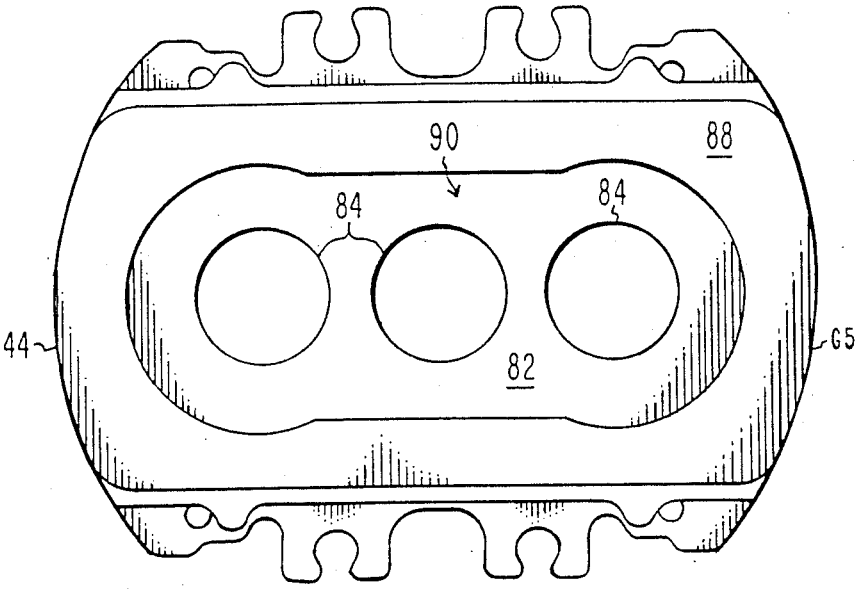
FIG. 4 is a sectional view of an electrode of the electron gun taken at line 4—4 of FIG. 3.

The shape of the large aperture 90 formed by the second portion 88 of the G5 electrode 44 is shown in FIG. 4. The aperture 90 is vertically wider at the side electron beam paths than it is at the center beam path. Such shape has been referred to as the "dogbone" or "barbell" shape. The shape of the large aperture 58 in the second portion 56 of the first part 51 of the G3 electrode 38 is similar to that of the aperture 90.

Figure 5:
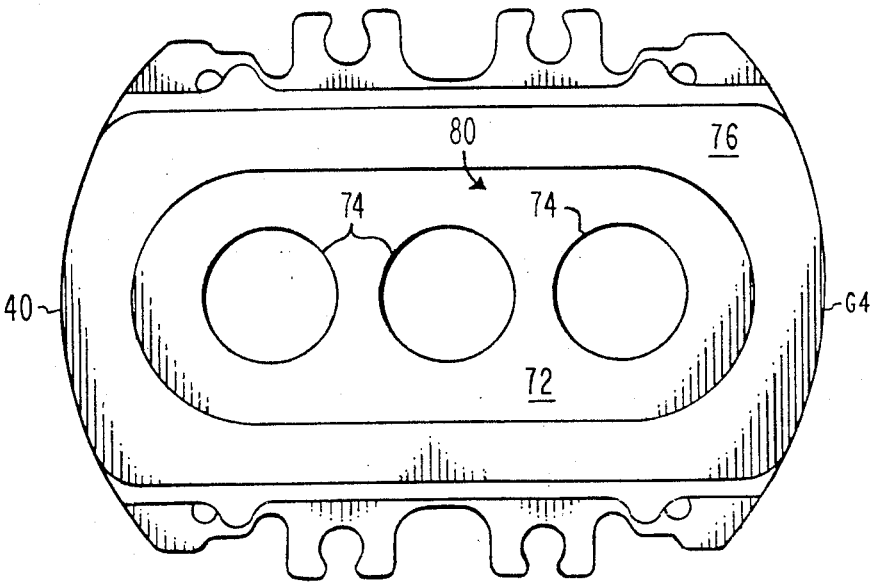
FIG. 5 is a sectional view of an electrode of the electron gun taken at line 5—5 of FIG. 3.

The shape of the large aperture 80 in the second portion 76 of the third part 62 of the G4 electrode 40 is shown in FIG. 5. This aperture 80 has a uniform vertical width at each of the electron beam paths with rounded ends. Such shape has been referred to as the "racetrack" shape. The shape of the large aperture 71 in the first portion 69 of the first part 60 of the G4 electrode 40 is similar to that of the aperture 80.

In constructing the electron gun 26, the grid thicknesses and spacings within the beam-forming region of the gun are chosen to produce easily focused electron beams. The electrodes forming the einzel lens are designed and dimensioned to give a desired focusing behavior. Tables I and II present specific dimensions for two different variations of the electron gun 26.

TABLE I

| | Inches | Millimeters |
|---|---|---|
| Cathode to G1 spacing | 0.0030 | 0.0762 |
| G1 thickness | 0.0045 | 0.1143 |
| G1 to G2 spacing | 0.0100 | 0.2540 |
| G2 thickness | 0.0120 | 0.3048 |
| Diameter of apertures 65 & 67 | 0.0250 | 0.6350 |
| G2 to G3 spacing | 0.1200 | 3.0480 |
| G3 bottom thickness | 0.0100 | 0.2540 |
| Diameter of apertures 64 | 0.0600 | 1.5240 |
| Overall G3 length | 0.7750 | 19.6850 |
| Overall G4 length | 0.4000 | 10.1600 |
| Spacing of apertures 65, 67, 64, 54, 68, 74 & 84 | 0.2000 | 5.0800 |
| Diameter of apertures 54, 68, 74 & 84 | 0.1600 | 4.0640 |
| Depth of recesses in G3, G4 & G5 | 0.1400 | 3.5560 |
| Length of large apertures 58 & 90 | 0.6830 | 17.3482 |
| Minimum width of apertures 58 & 90 | 0.2790 | 7.0866 |
| Maximum width of apertures 58 & 90 | 0.2900 | 7.3660 |
| Length of large apertures 71 & 80 | 0.7200 | 18.2880 |
| Width of large apertures 71 & 80 | 0.3350 | 8.5090 |

Computer simulations predict that the center electron beam for an electron gun constructed with the dimensions given in Table I, when operated at 25 1 kV ultor voltage and 4 mA beam current in a 26 V 110 tube, will have a 5% of peak current intensity beam size of 2.01 mm×2.74 mm (H×V). The gun focuses at 9.2 kV (37% of ultor voltage) and has near-zero outer beam misconvergence.

TABLE II

| | Inches | Millimeters |
|---|---|---|
| Cathode to G1 spacing | 0.0030 | 0.0762 |
| G1 thickness | 0.0045 | 0.1143 |
| G1 to G2 spacing | 0.0100 | 0.2540 |
| G2 thickness | 0.0160 | 0.4064 |
| Diameter of apertures 65 & 67 | 0.0250 | 0.6350 |
| G2 to G3 spacing | 0.1200 | 3.0480 |
| G3 bottom thickness | 0.0100 | 0.2540 |
| Diameter of side apertures 64 | 0.0660 | 1.6764 |
| Diameter of center aperture 64 | 0.0600 | 1.5240 |
| Overall G3 length | 0.5950 | 15.1130 |
| Overall G4 length | 0.5800 | 14.7320 |
| Spacing of apertures 65, 67, 54, 68, 74 & 84 | 0.2000 | 5.0800 |
| Spacing of apertures 64 | 0.2030 | 5.1562 |
| Depth of recesses in G3 & G5 | 0.2050 | 5.2070 |
| Depth of recesses in G4 | 0.1200 | 3.0480 |
| Length of large apertures 58 | 0.7350 | 18.6690 |
| Minimum width of apertures 58 & 90 | 0.3060 | 7.7724 |
| Maximum width of apertures 58 & 90 | 0.3360 | 8.5344 |
| Length of large apertures 71 & 80 | 0.6850 | 17.3990 |
| Width of apertures 71 & 80 | 0.3000 | 7.6200 |
| Depth of G3 slots | 0.0300 | 0.7620 |
| Vertical dimension of G3 slots | 0.1300 | 3.3020 |
| Width of center G3 slot | 0.0640 | 1.6256 |
| Width of outer G3 slots | 0.0720 | 1.8288 |

The electron gun of Table II has several significant differences from the electron gun of Table I. First, the bottom of the G3 electrode has slightly larger center-to-center aperture spacing. This increased spacing helps reduce the sensitivity of the gun to focus voltage variations. Also, there are vertically elongated slots superposed on the apertures in the bottom of the G3. The dimension of the three electrodes forming the einzel lens are also considerably different in the two gun versions. The G3-bottom slots reduce the vertical beam heights in the main focus lens and yoke regions and has a three-fold purpose. First, the reduction in vertical beam heights in the main lens induces a further reduction in misalignment sensitivity. Second, the reduced main lens beam sizes causes an increase in low current vertical spot sizes and a resultant reduction in moiré. Finally, reduced vertical beam sizes in the yoke region reduces the amount of yoke induced beam distortions; these distortions acting primarily in the vertical direction.

Computer simulations predict that the center electron beam for an electron gun constructed with the dimensions given in Table II, when operated at 25 kV ultor voltage and 4 mA beam current in a 26 V 110 tube, will have a 5% of peak current intensity beam size of 1.95 mm×2.76 mm (H×V).

Figure 8A:
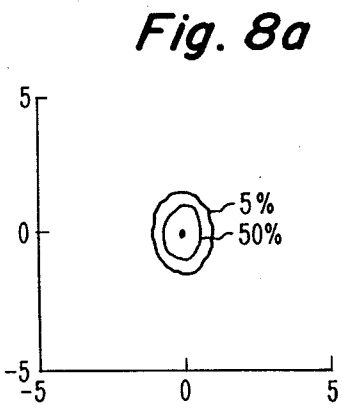
FIGS. 8*a* and 8*b* are graphs showing electron beam spot shapes in a second novel color picture tube having an aligned BFR and a misaligned BFR, respectively.
Figure 7A:
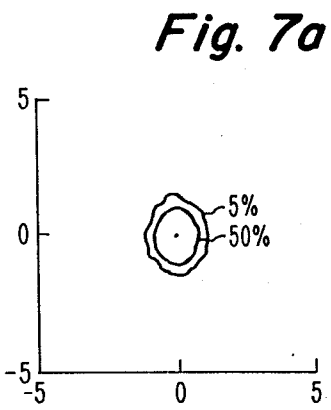
FIGS. 7*a* and 7*b* are graphs showing electron beam spot shapes in a first novel color picture tube having an aligned BFR and a misaligned BFR, respectively.
Figure 6A:
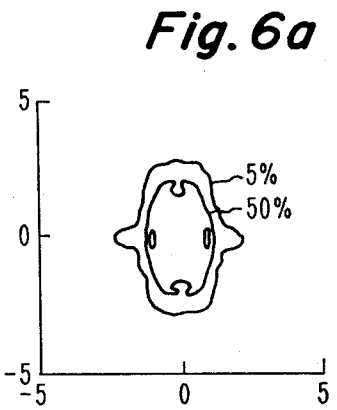
FIGS. 6*a* and 6*b* are graphs showing electron beam spot shapes in a prior art color picture tube having an aligned BFR and a misaligned BFR, respectively.
Figure 8B:
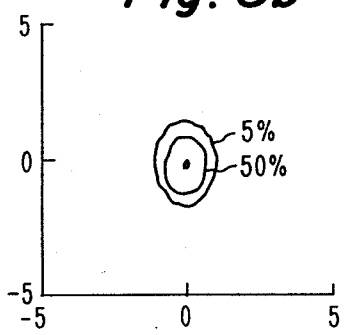
Figure 7B:
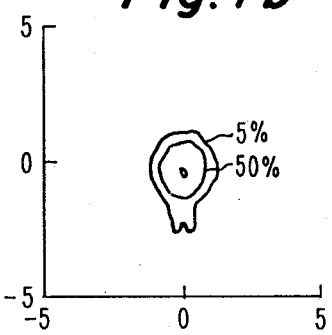
Figure 6B:
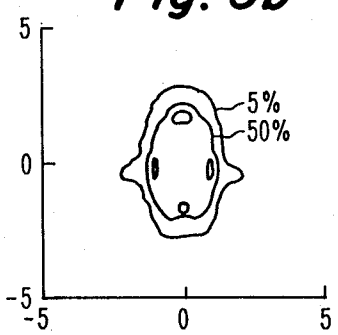

The results of computer simulations for electron beam sizes are summarized in Table III and are visually presented in FIGS. 6*a*, 6*b*, 7*a*, 7*b*, 8*a* and 8*b*. FIGS. 6*a*, 7*a* and 8*a* show the electron beam spot shapes at the centers of color picture tube screens for a prior art electron gun, the electron gun of Table I and the electron gun of Table II, respectively, when these three electron guns have well aligned apertures in their beam forming regions. The 5% and 50% curves indicate contour lines of current intensity where the current intensity is 5% and 50%, respectively, of the peak intensity of the electron beam spots. FIGS. 6*b*, 7*b* and 8*b* show the center electron beam spot shapes for the three respective electron guns when the center apertures of the G2 electrodes are vertically misaligned by 1 mil (0.001 inch; 0.0254 mm). The spot sizes given in Table III are for the 5% current intensity contour in a 26 V 110 tube operated at a 25 kV ultor potential with a 4 mA electron beam current.

TABLE III

| | Prior Art Gun | Table I Gun | Table II Gun |
|---|---|---|---|
| Focus voltage on G4 | 5900 V | 9200 V | 8200 V |
| Aligned G2 | | | |
| Horizontal | 2.94 mm | 2.01 mm | 1.95 mm |
| Vertical | 5.42 mm | 2.74 mm | 2.76 mm |
| Misaligned G2 | | | |
| Horizontal | 2.93 mm | 2.11 mm | 1.99 mm |
| Vertical | 5.37 mm | 3.25 mm | 2.90 mm |

The foregoing results indicate that the two novel einzel lens electron guns produce smaller electron beam spots than do the prior art electron gun. However, the prior art electron gun is substantially insensitive to the 1 mil misalignment in the G2 electrode, as can be seen by comparing FIGS. 6*a* and 6*b*. Although the novel electron gun of Table I shows a large improvement in electron beam spot size, it does have some sensitivity to misalignment of the G2 electrode, as shown in FIG. 7*b*. The electron gun embodiment of Table II not only produces a small beam spot but also has a relative insensitivity to misalignment of the G2 electrode.

What is claimed is:

1. In a color picture tube including a neck, a funnel and a faceplate and having an inline electron gun in said neck for generating and directing three inline electron beams, a center beam and two side beams, along initially coplanar paths toward a screen of said tube, said gun including a plurality of spaced electrodes which form a main focus lens for focusing said electron beams, the improvement comprising said plurality of spaced electrodes which form a main focus lens including three electrodes that form an einzel lens in the path of the electron beams, a first of the einzel lens electrodes includes a first portion having three inline apertures that are set back from a second portion of the first einzel lens electrode that forms a single large aperture through which all three electron beams pass, a second of the einzel lens electrodes includes a first portion having three inline apertures that are set back from a second portion of the second einzel lens electrode that forms a single large aperture through which all three electron beams pass, the second portion of the first einzel lens electrode facing the second portion of the second einzel lens electrode, the second einzel lens electrodes also includes a third portion having three inline apertures that are set back from a fourth portion of the third einzel lens electrode that forms a single large aperture through which all three electron beams pass, a third of the einzel lens electrodes includes a first portion having three inline apertures that are set back from a second portion of the third einzel lens electrode that forms a single large aperture through which all three electron beams pass, and the fourth portion of the second einzel lens electrode facing the second portion of the third einzel lens electrode.

2. In a color picture tube including a neck, a funnel and a faceplate and having an inline electron gun in said neck for generating and directing three inline electron beams, a center beam and two side beams, along initially coplanar paths toward a screen of said tube, said gun including a beam-forming region comprising at least two electrodes and a plurality of spaced electrodes which form a main focus lens for focusing said electron beams, the improvement comprising said plurality of spaced electrodes which form a main focus lens including three electrodes that form two spaced parts of the main focus lens in the path of the electron beams, a first of the main focus lens electrodes includes a first portion having three inline apertures that are set back from a second portion of the first main focus lens electrode that forms a single large aperture through which all three electron beams pass, a second of the main focus lens electrodes includes a first portion having three inline apertures that are set back from a second portion of the second main focus lens electrode that forms a single large aperture through which all three electron beams pass, the second portion of the first main focus lens electrode facing the second portion of the second main focus lens electrode, the second main focus lens electrodes also includes a third portion having three inline apertures that are set back from a fourth portion of the third main focus lens electrode that forms a single large aperture through which all three electron beams pass, a third of the main focus lens electrodes includes a first portion having three inline apertures that are set back from a second portion of the third main focus lens electrode that forms a single large aperture through which all three electron beams pass, the fourth portion of the second main focus lens electrode facing the second portion of the third main focus lens electrode, and said first and third main focus lens electrodes being electrically connected, whereby one part of the main focus lens is formed between the first and second main focus lens electrodes and a second part of the main focus lens electrodes is formed between the second and third main focus lens electrodes.

3. The tube as defined in claim 2 including means in the beam-forming region of the electron gun for reducing the vertical dimension of electron beam heights in the main focus lens.

4. The tube as defined in claim 3 wherein the means for reducing comprises vertically elongated slots superposed on apertures in a portion of the first main focus lens electrode of the beam-forming region of the electron gun.

* * * * *